US010006171B2

(12) United States Patent
Johnson et al.

(10) Patent No.: US 10,006,171 B2
(45) Date of Patent: Jun. 26, 2018

(54) METHODS AND COMPOSITIONS FOR ENHANCING SIZING IN PAPERMAKING PROCESS

(71) Applicant: Ecolab USA Inc., St. Paul, MN (US)

(72) Inventors: William C. Johnson, Chicago, IL (US); Bradley Benz, Parker, CO (US)

(73) Assignee: ECOLAB USA INC., St. Paul, MN (US)

( * ) Notice: Subject to any disclaimer, the term of this patent is extended or adjusted under 35 U.S.C. 154(b) by 0 days. days.

(21) Appl. No.: 15/137,797

(22) Filed: Apr. 25, 2016

(65) Prior Publication Data

US 2017/0306564 A1 Oct. 26, 2017

(51) Int. Cl.
*D21H 21/16* (2006.01)
*D21H 17/37* (2006.01)
*D21H 17/06* (2006.01)

(52) U.S. Cl.
CPC ..... *D21H 21/16* (2013.01); *D21H 17/06* (2013.01); *D21H 17/375* (2013.01)

(58) Field of Classification Search
CPC ..... D21H 1/00
USPC ..... 162/164.6
See application file for complete search history.

(56) References Cited

U.S. PATENT DOCUMENTS

| | | | | |
|---|---|---|---|---|
| 4,415,690 | A | 11/1983 | Grimm | |
| 4,657,946 | A | 4/1987 | Rende et al. | |
| 6,491,790 | B1 | 12/2002 | Proverb et al. | |
| 6,743,335 | B2 | 6/2004 | Proverb et al. | |
| 7,641,766 | B2 | 1/2010 | St. John et al. | |
| 8,709,207 | B2 | 4/2014 | Grimm et al. | |
| 8,840,759 | B2 | 9/2014 | Benz et al. | |
| 8,852,400 | B2 | 10/2014 | St. John et al. | |
| 9,028,650 | B2 | 5/2015 | Ehrhardt et al. | |
| 2006/0142535 | A1* | 6/2006 | Cyr | C08F 220/56 528/230 |
| 2008/0277084 | A1 | 11/2008 | Denowski et al. | |
| 2012/0103547 | A1* | 5/2012 | Grimm | D21H 17/06 162/164.1 |
| 2013/0192782 | A1* | 8/2013 | Benz | D21H 17/16 162/164.6 |
| 2014/0130994 | A1 | 5/2014 | St. John et al. | |
| 2015/0020988 | A1 | 1/2015 | St. John et al. | |
| 2016/0010282 | A1 | 1/2016 | Haufe et al. | |
| 2016/0097160 | A1 | 4/2016 | Castro et al. | |

FOREIGN PATENT DOCUMENTS

| | | | |
|---|---|---|---|
| EP | 2463020 | A2 | 6/2012 |
| WO | WO 2014/073145 | A1 | 5/2014 |

OTHER PUBLICATIONS

Jenkins, "The use of alkenyl succinic anhydride for sizing recycled fibres," TAPPSA Journal; Nov. 2001.
PCT International Search Report and Written Opinion for PCT/US2017/029069, dated Jul. 30, 2017, 13 pages.

* cited by examiner

*Primary Examiner* — Mark Halpern
(74) *Attorney, Agent, or Firm* — Eric D. Babych; Brinks Gilson & Lione

(57) ABSTRACT

The disclosure relates to methods and compositions for enhancing the performance of a sizing agent in a papermaking process using a sizing agent enhancer. The sizing agent can be emulsified with an emulsifier and the sizing enhancer can be a polymer comprising at least one primary or secondary amine containing monomer. The method can comprise emulsifying the sizing agent with the emulsifier; and thereafter adding the emulsified sizing agent and the sizing enhancer, separately from or contemporaneously with the emulsified sizing agent, to a fiber furnish of a papermaking process. The combination of the emulsified sizing agent and the sizing enhancer improves the sizing of product paper over the use of the sizing agent without the sizing enhancer. In at least some embodiments, the emulsified sizing agent is ASA emulsified with a polymer comprising at least one primary or secondary amine containing monomer and the sizing enhancer comprises a diallylamine-acrylamide copolymer.

18 Claims, 3 Drawing Sheets

METHODS AND COMPOSITIONS FOR ENHANCING SIZING IN PAPERMAKING PROCESS

CROSS-REFERENCE TO RELATED APPLICATIONS

Not Applicable

STATEMENT REGARDING FEDERALLY SPONSORED RESEARCH OR DEVELOPMENT

Not Applicable.

FIELD OF THE INVENTION

The present invention relates generally to compositions and methods for improving sizing in paper and paperboard production. More specifically, the present invention relates to compositions and methods for enhancing sizing performance of sizing agents, in particular alkenyl succinic anhydride emulsions, in papermaking processes.

BACKGROUND OF THE INVENTION

In the papermaking industry, "sizing" is the treatment of paper which gives it resistance to the penetration of liquids (particularly water) or vapors. Sizing is also employed to improve ink holdout. Imparting such resistance to hydrophilic liquid penetration (normally water) is an important property of paper, both in the papermaking process and in the final product. Sizing agents are used in the papermaking process to increase wood fiber's resistance to liquid penetration. The resistance to the absorption of liquids is desired when the paper product is purposefully wetted during a converting process (printing or laminating) or accidentally wetted (packaging containers or newspapers).

Generally, resistance to water penetration is achieved by the introduction of a sizing agent at the wet-end of the papermaking process. A common sizing agent is alkenyl succinic anhydride ("ASA"). Alkenyl succinic anhydride (ASA) is an internal sizing agent, which is commonly used to treat fibers in the papermaking process, making them more hydrophobic. Internal sizing refers to the treatment of the wood fibers prior to forming a wet web. ASA is a water insoluble oil that is essentially nonionic in nature. Therefore, ASA must be emulsified before it is added to the papermaking process. Emulsification of ASA produces an oil-in-water emulsion and also cationizes ASA emulsion droplets. Cationizing the ASA droplets helps to promote emulsion stability and aids in ASA retention. Common cationic emulsifiers for ASA include derivatized starches and synthetic acrylamide-based polymers.

Application of sizing agents involves numerous considerations. For example, the extent to which a paper is weakened by the rewetting at the size press during production is influenced by its degree of sizing. Additionally, a high level of internal sizing of a sheet contributes to the sheet's structural stability in environments where the sheet may come in contact with liquid water. Beverage and food packaging are typical examples of the use of board and paper products where a high level of sizing is desirable.

A drawback to using ASA as a sizing material is that ASA is not water soluble and typically must be uniformly suspended in the pulp as an emulsion so that the ASA can make adequate contact with the cellulosic fibers and, thus, create the desired effect on the final product. Efforts to address performance of ASA have been made. However, conventional methods can have issues regarding shelf life, emulsion stability and equipment use.

Despite available technologies, there exists a need to improve or enhance sizing performance and efficiency in paper production processes. There also exists an ongoing industrial need in the papermaking industry to develop sizing formulations and methods that improve sizing of paper and paperboard and provide enhancements to the papermaking process.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 CFR § 1.56(a) exists.

SUMMARY OF THE INVENTION

The present invention relates to methods and compositions for enhancement of sizing treatments in a papermaking process. Surprisingly, emulsified ASA sizing performance is enhanced when combined with an amine-based chemistry, wherein both are added, separately or contemporaneously, to a wet-end of the papermaking process. Combining the amine-based chemistry with the sizing emulsion also has the ability to enhance strength properties of the paper/board.

In at least one embodiment, the invention includes a method of sizing paper produced by a papermaking process. The method comprises adding, separately or contemporaneously, each of an emulsified sizing agent and a sizing agent enhancer to a fiber furnish of a papermaking process. In at least some embodiments, each are added at or before a headbox of the papermaking process. In these and other exemplary embodiments, the sizing agent can be emulsified with an emulsifier comprising an emulsifier polymer comprising at least one primary or secondary amine containing monomer; and the sizing agent enhancer comprises a polymer comprising at least one primary or secondary amine containing monomer. In at least some embodiments, the polymer of the sizing agent enhancer is a copolymer comprising diallylamine ("DAA") monomers; and in further embodiments, the emulsifier polymer comprises DAA monomers.

In at least some embodiments, both the sizing agent and the sizing agent enhancer are added to thick-stock furnish; and, in some embodiments, both the sizing agent and the sizing agent enhancer are added to the thin-stock fiber furnish. In still further embodiments, the sizing agent enhancer is add to the fiber furnish, thin or thick stock, and the sizing agent is added to the thin-stock furnish. In these and other various embodiments, the sizing agent and the sizing agent enhancer are added separately or together. In at least some embodiments, each are added at or before the headbox of the papermaking process.

In at least some embodiments, the emulsified sizing agent is added to the thin-stock furnish flow of the fiber furnish and the sizing agent enhancer is added the thick and/or thin furnish flow, each added at or before the headbox. In these and other various embodiments, the emulsified sizing agent can be added:

- before or after screening in the papermaking process;
- before the sizing enhancer, wherein the emulsified sizing agent is added before or after screening and the sizing agent is added after screening; or before, after or contemporaneously with the sizing enhancer, wherein both the sizing enhancer and the emulsified sizing agent are added after screening.

In at least one embodiment, the sizing enhancer is added to the thin-stock furnish flow before or after screening in the papermaking process. In at least one embodiment, the emulsified sizing agent and the sizing enhancer are further added contemporaneously or in immediate succession to the thin-stock furnish flow after screening in the papermaking process. In these and other various embodiments, the emulsified sizing agent and the sizing enhancer can be added contemporaneously through a common conduit or separate conduits.

In at least one embodiment, the invention includes a method of sizing paper produced by a papermaking process comprising adding an emulsified sizing agent to a fiber furnish of a papermaking process. In this and other exemplary embodiments, the sizing agent is emulsified with an emulsifier comprising an emulsifier polymer comprising DAA monomers. In these and other various embodiments, the emulsifier polymer is a copolymer having 1-60 mol % DAA. In at least some embodiments, the emulsified sizing agent is added at or before a headbox of the papermaking process, and, in further embodiments, to the thin-stock furnish.

In the above and various other embodiments herein, the sizing enhancer can comprise a copolymer of DAA and at least 1% of AcAm, methacrylamide or a mixture thereof a dimethylaminoethylmethacrylate—methyl chloride quaternary polymer; glyoxalated polyacrylamide; aqueous carbohydrate dispersion; or mixtures thereof. In at least some embodiments, the sizing enhancer comprises a copolymer of diallylamine and acrylamide ("DAA/AcAm").

In these and various other embodiments, the sizing agent can comprise various suitable sizing agents, including an alkyl ketene dimer ("AKD"), an alkenyl succinic anhydride ("ASA") or mixtures thereof. The sizing agent is emulsified with an emulsifier, the emulsifier comprising a polymer comprising at least one primary or secondary amine containing monomer. In at least some embodiments, the sizing agent is ASA emulsified in a polymer comprising at least one primary or secondary amine containing monomer.

In these and other various embodiments, the emulsified sizing agent can comprise an oil-in-water emulsion. In at least some embodiments, the oil-in-water emulsion comprises a sizing agent, such as an alkenyl succinic anhydride, and an emulsifier, wherein the emulsifier is a polymer comprising from 1 to 60 mol % of at least one amine-containing vinyl- or allyl-monomer, and the remainder of the polymer comprising a nonionic monomer selected from the group consisting of: acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, and combinations thereof. In some embodiments, the polymer comprises from 10 to 60 mol % of the at least one amine-containing vinyl- or allyl-monomer.

In further embodiments, the polymer of the emulsifier comprises: a copolymer of diallylamine and at least 1% of AcAm, methacrylamide or a mixture thereof; a dimethylaminoethylmethacrylate—methyl chloride quaternary polymer; glyoxalated polyacrylamide; an aqueous carbohydrate dispersion, for example starch; or mixtures thereof. In at least some embodiments, the polymer of the emulsifier comprises a copolymer of diallylamine and acrylamide. In at least one embodiment, the emulsifier comprises a polymer comprising diallylamine monomers combined with starch.

In at least some embodiments, the emulsified sizing agent comprises from 0.01 weight percent to 40 weight percent of the sizing agent. In some embodiments, the emulsified sizing agent comprises 0.001 weight percent to 20 weight percent of the emulsifier. In still further embodiments, the emulsified sizing agent comprises 8-12 weight percent of the sizing agent and 1-5 weight percent of the emulsifier. In these and other various embodiments, as an example, the sizing agent can be ASA and the emulsifier can be a copolymer of diallylamine and acrylamide.

In these and various other embodiments, the emulsifier polymer or copolymer of the emulsified sizing agent can have a mole percent of diallylamine ranging from about 1 to about 99 percent. In some embodiments, the emulsifier polymer or copolymer of the emulsified sizing agent comprises about 1 to 60 mol % diallylamine and, in some embodiments, 10 to 40 mol %.

In these and other various embodiments, the emulsified sizing agent can have an emulsion particle size ranging from about 0.01 to about 10 microns.

In these and various other embodiments, the sizing enhancer can be added to the furnish flow at a dosage rate of 0.5 to 35 lbs. of the sizing enhancer per ton of dry fiber. In further embodiments, the sizing enhancer is added at a dosage rate of 1 to 20 lbs. of the sizing enhancer per ton of dry fiber. In still further embodiments, the sizing enhancer is added at a dosage rate of 2.0 lbs. to 12.5 lbs. of the sizing enhancer per ton of dry fiber.

In these and various other embodiments, the emulsified sizing agent can be added to the furnish flow at a dosage rate of 0.5 lbs. to 20 lbs. of the emulsified sizing agent per ton of dry fiber. In some embodiments, the adding of the emulsified sizing agent is performed at a dosage rate of 0.5 lbs. to 10 lbs. of the emulsified sizing agent per ton of dry fiber.

In these and other various embodiments, the method can comprise adding a cationic agent to the papermaking process, wherein the cationic agent is selected from the group consisting of: alum, aluminum chloride, polyaluminum chloride, long chain fatty amines, sodium aluminate, substituted polyacrylamide, chromic sulfate, cationic thermosetting resins, a polyamide polymer, an amine-containing starch derivative, and combinations thereof.

In these and other various embodiments, the method further comprises making a paper product out of the furnish according to a papermaking process. The emulsified sizing agent and sizing enhancer are added in an amount sufficient to size the paper product and the paper product exhibits increased resistance to fluid penetration, including liquid and gas, over using the emulsified sizing agent without the sizing enhancer.

In at least one embodiment, the invention includes a method of sizing paper during the papermaking process. The method comprises: adding an oil-in-water emulsion to the papermaking process in an amount sufficient to size the paper; and adding after screening and at or before a headbox in the papermaking process a sizing enhancer to the papermaking process in an amount sufficient to enhance the oil-in-water emulsion in the size of the paper. In some embodiments, the oil-in-water emulsion comprises alkenyl succinic anhydride emulsified with a copolymer consisting of diallylamine and at least one of acrylamide. The sizing enhancer can comprise at least one primary or secondary amine containing monomer. In some embodiments, the sizing enhancer comprises a copolymer of diallylamine and acrylamide.

The above summary of various aspects of the disclosure is not intended to describe each illustrated aspect or every implementation of the disclosure. While multiple embodiments are disclosed, still other features, embodiments and advantages of the present invention will become apparent to those skilled in the art from the following detailed description, which shows and describes illustrative embodiments of the invention. Accordingly, the detailed description is to be regarded as illustrative in nature and not restrictive.

BRIEF DESCRIPTION OF THE DRAWINGS

A detailed description of the invention is hereafter described with specific reference being made to the drawings in which.

For the purposes of this disclosure, like reference numerals in the figures shall refer to like features unless otherwise indicated. The drawings are only an exemplification of the principles of the invention and are not intended to limit the invention to the particular embodiments illustrated.

DETAILED DESCRIPTION OF THE INVENTION

Figure 1:
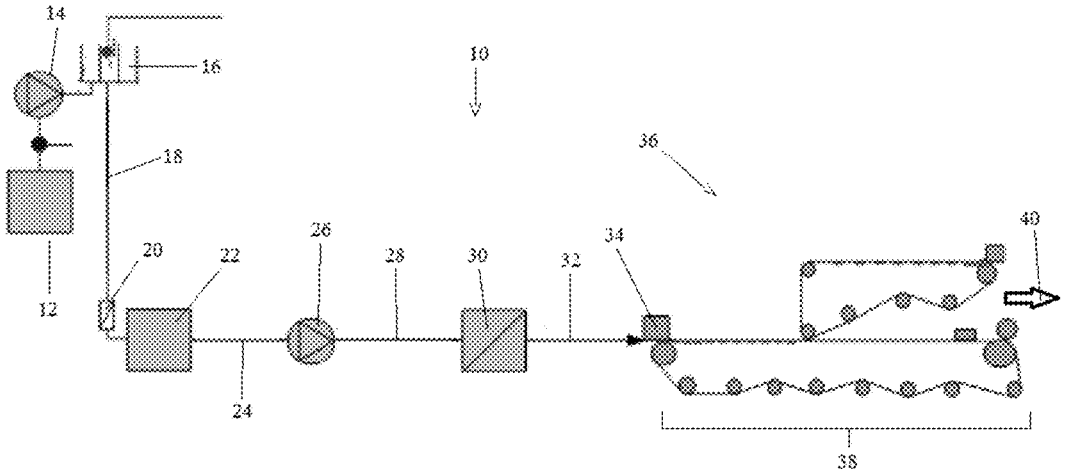
FIG. 1 is a schematic of a wet-end and paper machine of a typical in a papermaking process.

The inventors have discovered that the employment of the combination of an emulsion, which can be an oil-in-water emulsion, comprising a sizing agent, ASA for example, emulsified with an amine-containing polymer, for example diallylamine or diallylamine-acrylamide copolymers; and a sizing agent enhancer, which, in some embodiments, comprises an amine-containing polymer, for example a diallylamine-acrylamide copolymer, in the papermaking process surprisingly provides outstanding improvements in sizing performance without significantly affecting particle size distribution parameters.

Unless otherwise defined herein, all technical and scientific terms used herein have the same meaning as commonly understood by one of ordinary skill in the art. In case of conflict, the present document, including definitions, will control. The following definitions are provided to determine how terms used in this application are to be construed. The organization of the definitions is for convenience only and is not intended to limit any of the definitions to any particular category.

"AKD" refers to an alkylketene dimer, a synthetic sizing agent in the form of an aqueous dispersion of waxy particles, useful for wet-end addition.

"ASA" refers to an alkenylsuccinic anhydride, a synthetic sizing agent that usually is emulsified with cationic starch just before addition to a paper machine wet-end.

"Amine-containing polymer" is used interchangeably herein with the phrase "a polymer comprising at least one primary or secondary amine containing monomer."

"Approach Flow System" refers to the stock flow from the fan pump to the headbox.

"Chest" refers to a vessel equipped with an agitating device for storing, collecting, mixing, blending and/or chemical treatment of pulp suspension. Chest can be horizontal and or vertical. Towers are a special type of chest generally used in a bleach plant to provide retention time and to provide down/upward flow out of pulp.

"Curing" refers to reactions of certain sizing agents and wet-strength agents that occur during the drying of paper.

"Dewatering" refers to the removal of water in a papermaking process. Dewatering techniques are typically applied to each of the major sections of a paper machine, which typically consist of: forming section, press section and dryer section. In forming section dewatering, the fibers present in the diluted pulp and water slurry form paper web and dewatering can occur through drainage by gravity and applied suction below the forming fabric. In the press section dewatering, dewatering can occur by additional water being removed by mechanical pressure applied through the nips of a series of presses or rotating rolls and the wet web is consolidated in this section. Dewatering further occurs through evaporation as inter-fiber binding developed as the paper contacts a series of steam heated cylinder in the dryer section.

"Fan Pump" or "Stock Pump" refers to a high flow rate, low head pump used to pump diluted stock to paper machine headbox. A Fan Pump can be equipped to receive and dilute thick-stock furnish with white water and send thin-stock furnish to the headbox.

"Feathering" refers to the tendency of ink to spread out in an irregular pattern due to wicking and/or an insufficient level of sizing agents in paper "Fiber furnish" refers to a blend of fibers and water and other materials, which can include, but not limited to, pigments, dyes and fillers, that are fed to the wet-end of the paper machine.

"Fugitive sizing" refers to a tendency of certain paper samples to temporarily lose their water-resistant properties.

"Hard sizing" refers to the strong resistance of paper to penetration by water or other fluid, over a long time.

"Headbox", also referred to as "Flow Box" or "Breast Box", refers to the part of a paper machine of a papermaking process whose primary function is to deliver a uniform dispersion of fibers in water at the proper speed through the slice opening to the paper machine wire. The Headbox is positioned after the Pressure Screen in a papermaking process.

"Hydrolyzate" refers to the breakdown product of a reactive sizing agent, leading to a net decrease in efficiency and possible deposit problems.

"Interfering substance" refers to something in the aqueous mixture that interferes with the function of papermaking additives such as retention aids, sizing agents, strength agents, etc.

"Machine Chest" refers to a container or point in a papermaking process that contains thick-stock pulp. The Machine Chest is usually the last large chest or tank that contains thick-stock pulp before it is diluted to form thin-stock furnish and thereafter made into paper.

"Reactive size" refers to a sizing agent such as ASA or AKD that undergoes a covalent reaction when heated in the presence of fibers.

"Paper" and "sheet" are used interchangeably to mean an intermediate or product of a papermaking process made from an aqueous cellulosic papermaking furnish (optionally, with mineral fillers, such as calcium carbonates, clays, etc.)

that has been formed into a layer. Depending on the context, paper or sheet could mean an intermediate or a product of a papermaking process.

"Polymer" means homopolymer, copolymer, or any organic chemical composition made up of bonded repeating "mer" units unless the particular context makes clear that one species is intended.

"Pressure Screen" or "Screen" refers devices in a papermaking process used to remove large solids particles such as fiber bundles and flakes from stock. The Pressure Screen is positioned just before the headbox of a papermaking process.

"Sizing" refers to the treatment of paper which gives it resistance to the penetration of fluids, including liquids (particularly water) and gases/vapors. Sizing improves ink holdout. Sizing reduces the water absorbency of the paper and thus creates the condition for the writability with ink. Sized paper is also used for many other purposes (printing, coating, gluing, etc.), and the sizing agents must fulfill a wide range of tasks. For instance, they control the water absorbency and increase the ability to retain water and ink (pick resistance).

"Size press" refers to equipment, typically included as part of a papermaking machine, for applying a solution to the surface of paper just after it has been dried for the first time, usually by means of a puddle and nip between rolls or by metering the solution onto a rubber roll. Typically, the solution contains sizing agents, including resins, glue, or starch, and is applied to alter the paper's characteristics.

"Size reversion" refers to a tendency for certain types of sized paper to gradually lose their water-resistant nature.

"Internal Sizing" refers to treatment of the fiber slurry so that the paper will resist fluids.

"Surface sizing" refers to the addition of a film of starch solution or other material at the paper surface.

"Surface-Sized" refers to paper that has been treated with starch or other sizing material at the size press of the paper machine. This term is used interchangeably with the term "tub-sized", although tub-size more properly refers to surface sizing applied as a separate operation where the paper is immersed in a tub of sizing (starch or glue), after which it passes between squeeze rolls and is air dried.

"Stock" refers to the pulp after mechanical (refining or beating) and/or chemical treatment (sizing, loading, dying etc.) in the paper making process; a pulp ready to make paper.

"Stock Flow" refers to the stream or path of stock from the machine chest to the headbox.

"Stuff Box" or "Blending Box" refers to a chest in which pulp pumped from a Machine Chest can be blended or mixed with other pulps. The Stuff Box is located after the Machined Chest and before the White Water Chest in a papermaking process.

"Thick-stock furnish" refers to fiber furnish prior to dilution and is typically a mixture of papermaking pulp and other materials with a typical consistency of about 2 to 5%.

"Thin-stock furnish" refers to fiber furnish after being diluted with white water and is typically a mixture of papermaking pulp and other materials, after having been diluted with whitewater; Thick-stock furnish is diluted to form Thin-stock furnish.

"Wet-End Operations" or "Wet-End" refers generally to the parts of a papermaking process between pulping (or bleaching) and wet-pressing of the paper; typically includes to the section of the papermaking process that involves the fiber slurry, fillers and other chemical additives and would be obvious to those skilled in the art; and can also include the headbox, forming wire and wet press sections where the sheet is formed from the stock furnish and most of the water is removed prior to entering the dryer section.

"White Water" refers to the filtrate or process water used in the Wet-End of the paper machine or papermaking process to dilute Thick-stock furnish to form Thin-stock furnish. White Water is removed from the furnish during formation of the sheet and can be recycled. White Water is combined with and dilutes the Thick-stock furnish after the Machine Chest and at or before a Fan Pump.

"White Water Chest" ("WWC") refers to a chest or tank or point in a papermaking process that receives and can mix thick-stock furnish with white water to form thin-stock furnish or that receives thin-stock furnish after it is diluted from thick-stock furnish. A WWC can be located after the Machine Chest and Stuff Box and prior to a Fan Pump.

"White Water System" refers to the flow circuit for paper machine white water (includes pipes, storage tanks, cleaning equipment, water from forming section and return feed).

In the event that the above definitions or a description stated elsewhere in this application is inconsistent with a meaning (explicit or implicit) which is commonly used, in a dictionary, or stated in a source incorporated by reference into this application, the application and the claim terms in particular are understood to be construed according to the definition or description in this application, and not according to the common definition, dictionary definition, or the definition that was incorporated by reference. In light of the above, in the event that a term can only be understood if it is construed by a dictionary, if the term is defined by the *Kirk-Othmer Encyclopedia of Chemical Technology,* 5th Edition, (2005), (Published by Wiley, John & Sons, Inc.) this definition shall control how the term is to be defined in the claims. All illustrated chemical structures also include all possible stereoisomer alternatives.

While the invention is susceptible of embodiment in many different forms, this disclosure will describe various embodiments of the invention with the understanding that the present disclosure is to be considered as an exemplification of the principles of the invention and is not intended to limit the broad aspect of the invention to the embodiments illustrated.

In at least some embodiments of the present invention, a combination of emulsified sizing agent and sizing agent enhancer are added to fiber furnish of a papermaking process in an amount sufficient to size the paper product and the resulting paper product exhibits increased resistance to fluid, liquid or gas penetration over using the emulsified sizing agent without the sizing enhancer. In at least some embodiments, the emulsified sizing agent is ASA emulsified in a polymer comprising at least one primary or secondary amine containing monomer and the sizing agent enhancer comprises a polymer comprising at least one primary or secondary amine containing monomer and effectuates improved confirmation and retention of the ASA.

Papermaking Process Wet-End

Referring now to FIG. 1, there is shown a schematic of a wet-end and paper machine of a typical papermaking process 10. Papermaking processes and equipment, chemicals and process protocols are well known to those skilled in the art. Some processes may differ in steps and order without affecting the novel concepts of the present invention. The schematic of FIG. 1 is shown for illustrative and reference purposes and should not be seen as limiting the scope of the invention herein to the specific arrangement shown in the figure.

From upstream to downstream of stock flow in a papermaking process, the wet-end comprises a machine chest 12, wherein refined pulp stock is collected and prepared for blending and the incorporation of chemical additives. Blending can be done prior to or in the machine chest 12. For purposes of the present invention, from this point forward to the headbox, the pulp stock or stock contained is referred to as furnish or fiber furnish. Also, until the fiber furnish is diluted later in the process, it can be referred to as thick-stock furnish.

The machine chest 12 is in fluid communication with a stuff box 16. Thick-stock furnish, or fiber furnish, is transferred to a stuff box 16, which also may be referred to as a blending box, via a pump 14 (also called "machine chest pump" or "MC Pump"). In the stuff box 16, the thick-stock furnish can be blended with other refined pulp stocks.

The thick-stock furnish is thereafter pumped through a conduit 18 to a chest 22 (also referred to as a "white water chest" or "WW Chest"), during which the thick-stock furnish is diluted with white water to form thin-stock furnish. A valve (also referred to as "Main Stock valve" or "BW valve") 20 may be included to regulate flow and consistency of the thin-stock furnish.

Thin-stock furnish collected in the WW Chest 22 travels through a conduit 24 and pumped forward on toward the headbox 34 via pump 26 (also referred to as "Fan Pump"). The thin-stock furnish flows through conduit 28 to a pressure screen 30, wherein the thin-stock furnish is screened to remove large contaminants. The process can also include one or more cleaners, for example a centrifugal cleaners, typically positioned prior to the pressure screen, to remove particles that are lighter or heavier that the pulp in the thin-stock furnish. Such equipment and processes are well known to those skilled in the art.

Thereafter, the screened thin-stock furnish travels downstream to the headbox 34 of the papermaking machine 36. The headbox 34, which distributes fibers onto wire, is the introduction of the thin-stock furnish to the papermaking machine. A typical papermaking machine further includes a forming section 38, wherein sheets are formed and water is removed. Paper is then moved on 40 to typical latter portions (not shown) of the papermaking machine 36, including a press section, which removes more water and improves smoothness and bonding; a dryer section, which dries the paper using steam; and a paper reel, which rolls up the paper.

Sizing Application

The present disclosure provides for a method of sizing in a papermaking process. In at least some embodiments, the method comprises, separately preparing an emulsified sizing agent and a sizing agent enhancer and adding the emulsified sizing agent and the sizing agent enhancer to a fiber furnish of the papermaking process. In at least some embodiments, the emulsified sizing agent is added to the fiber furnish separately or contemporaneously with the sizing agent enhancer.

As described further in this disclosure, in at least some embodiments, the sizing agent is emulsified in an amount of the sizing agent enhancer, which can function as an emulsifier, to form a combination emulsified sizing agent and sizing agent enhancer. In application, the combination is added to the fiber furnish of the papermaking process.

In at least one embodiment, the sizing agent enhancer and the emulsified sizing agent are prepared separately. Both are added to the fiber furnish, thick or thin stock, separately or contemporaneously. In at least some embodiments, the sizing agent enhancer is added prior to the emulsified sizing agent.

In further embodiments, the sizing agent enhancer is added to the fiber furnish, thick-stock or thin-stock of the papermaking process; and the emulsified sizing agent is added to thin-stock furnish of the papermaking process thereafter. In some embodiments, the emulsified sizing agent and the sizing agent enhancer are added to thin-stock furnish of the fiber furnish in the papermaking process.

In at least some embodiments, the sizing agent enhancer is added to fiber furnish in the papermaking process between the machine chest 12 and the headbox 34 and the emulsified sizing agent is added to the thin-stock furnish prior to the headbox 34. In these and other various embodiments, the emulsified sizing agent is added between the fan pump 26 and the headbox 34.

In further embodiments, both the sizing agent enhancer and the emulsified sizing agent are added to the thin-stock furnish. In still further embodiments, both the sizing agent enhancer and the emulsified sizing agent are added to the thin-stock furnish after screening 30 and before the headbox 34, either contemporaneously or consecutively. When added contemporaneously, the sizing agent enhancer and the emulsified sizing agent are injected into the thin-stock furnish flow through separate conduits and ports or the separate conduits are joined prior to the thin-stock furnish flow, for example in a "T" shaped conduit, and are injected through a single port in conduit 32.

In at least some embodiments, the sizing agent enhancer is added to the thick-stock furnish, and, in some embodiments, in or just subsequent to the MC12 and prior to the dilution of the thick-stock furnish. In some embodiments, the sizing agent enhancer is added to the thin-stock furnish prior to screening 30, and, in some embodiments, prior to the fan pump 26. As mentioned above, the sizing agent enhancer can be added between the screening 30 and the headbox 34, for example in conduit 32, before, after or contemporaneously with the emulsified sizing agent.

In these and other various embodiments, the emulsified sizing agent is added to the thin-stock furnish flow in or after the WW Chest 22 and before the headbox 34. In some embodiments, the emulsified sizing agent is added between the WW Chest 22 and the screening 30, and, in some, between the fan pump 26 and the screening 30. As mentioned above, the emulsified sizing agent can be added between the screening 30 and the headbox 34, for example in conduit 32, before, after or contemporaneously with the sizing agent enhancer.

As noted above, in other various embodiments, the sizing agent is emulsified with the sizing agent enhancer to form the emulsified sizing agent. The combination emulsified sizing agent and sizing agent enhancer, in at least some embodiments, is added to the fiber furnish, thick-stock or thin-stock furnish. In further embodiments, the combination is added to the thin-stock furnish, as described above in regard to the adding of emulsified sizing agent and/or sizing agent enhancer. In further embodiments, a further amount of sizing agent enhancer can be added to the fiber furnish separately or contemporaneously with the combination emulsified sizing agent and sizing agent enhancer. The combination emulsified sizing agent and sizing agent enhancer and the further amount of sizing agent enhancer are added to the fiber furnish as described above in regard to the separate or contemporaneous adding of the emulsified sizing agent and sizing agent enhancer, respectively.

Sizing Agent

In at least some embodiments, the sizing agent is ASA, AKD or mixtures thereof, and, in some embodiments, the sizing agent is ASA. Examples of suitable ASA compounds can include $C_{16}$ and higher based alkenyl succinic anhydrides and blends thereof. In some embodiments, suitable ASA compounds include, but are not limited to, $C_{18}$ based alkenyl succinic anhydride, $C_{16}/C_{18}$ based alkenyl succinic anhydride blend, and $C_{16}$ based alkenyl succinic anhydride. Examples of further sizing agents include, but are not limited to rosin and fluoropolymers. The sizing agent of the present invention can further be chosen from those disclosed, described and claimed in U.S. Pat. Nos. 8,852,400, 8,709,207, and 8,840,759 and U.S. Publication Nos. 20150020988 and 20140336314, which are herein incorporated by reference in their entireties.

ASA is commonly produced by the high temperature reaction of maleic anhydride ("MA") and a long chain internal olefin where the olefin to MA ratio is usually greater than 1. The type of olefin used to produce the ASA can have a significant impact on product performance. The olefins employed in commercial ASA sizes typically contain a carbon chain length of 16-18. However, it should be understood that ASA useful in the oil-in-water emulsions described herein may be prepared from olefins of different carbon chain lengths.

ASA compounds prepared from MA and various internal olefins are disclosed in U.S. Pat. No. 3,821,069. ASA compounds prepared from MA and mixtures of olefins, including internal olefins, are also disclosed in U.S. Pat. No. 6,348,132. The preparation of internal olefins by a metathesis reaction and a utility of the metathesized olefins in the preparation of ASA compounds are disclosed in U.S. Patent Application Publication No. 2003/0224945. Further disclosure and methods related to ASA useful in the invention disclosed herein are disclosed in U.S. Pat. Nos. 8,852,400, 8,709,207, and 8,840,759 and U.S. Publication Nos. 20150020988 and 20140336314. The disclosure of each of these references is herein incorporated by reference in their entireties.

Emulsifier

In these and other various embodiments, the emulsifier can be a polymer comprising at least one primary and/or secondary amine containing monomer (also referred to as an amine-containing polymer). In at least some embodiments, the polymer can be an amine-containing polymer consisting of or consisting essentially of DAA (a DAA homopolymer or essentially a DAA homopolymer), a copolymer of DAA, or any polymer that at least partially comprises DAA. In certain embodiments, the amine-containing polymer is a DAA/AcAm copolymer. In yet other embodiments, the amine-containing polymer is a mixture of DAA homopolymer and DAA/AcAm copolymer.

In these and other various embodiments, the emulsifier is a polymer comprising from 1 to 60 mol % of at least one amine-containing vinyl- or allyl-monomer, and the remainder of the polymer comprising a nonionic monomer selected from the group consisting of: acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, and combinations thereof. In some embodiments, the polymer comprises from 10 to 60 mol % of the at least one amine-containing vinyl- or allyl-monomer.

In at least some embodiments, the polymer of the emulsifier comprises a copolymer of diallylamine and at least 1% of AcAm, methacrylamide or a mixture thereof; a dimethylaminoethylmethacrylate—methyl chloride quaternary polymer; glyoxalated polyacrylamide; aqueous carbohydrate dispersion, for example starch; or mixtures thereof. In at least some exemplary embodiments, the polymer of the emulsifier is a copolymer of diallylamine and acrylamide.

In these and other various embodiments, the mole percentage of DAA in the polymer of the emulsifying agent can be within a range of 1 to 99 percent. In some embodiments, the polymer, for example a DAA/AcAm copolymer, can be primarily made up of DAA (more DAA monomer units than AcAm monomer units). In further embodiments, the mole percentage of DAA in the amine-containing polymer can be 1 to 60, and further 10 to 60, and still further 10 to 40. In various exemplary embodiments, the emulsifying agent is essentially DAA, DAA/AcAm or mixtures thereof.

In a further exemplary embodiment, the emulsifier comprises the sizing agent enhancer, wherein the sizing agent is essentially the emulsifier or is mixed with or combined with a further emulsifier. In exemplary embodiments, an amount of the sizing agent enhancer, for example DAA or DAA/AcAm, is used essentially as an emulsifier for the sizing agent, for example ASA, or is combined with a further emulsifier, for example starch or cooked starch, as an emulsifier for the sizing agent, for example ASA.

Further examples of an emulsifier for the present invention includes one or more of those disclosed, described and claimed in U.S. Pat. Nos. 8,852,400, 8,709,207, and 8,840,759 and U.S. Publication Nos. 20150020988 and 20140336314. The disclosure of each of these references is herein incorporated by reference in their entireties.

Emulsified Sizing Agent

In preparation of the emulsified sizing agent, a sizing agent, as disclosed herein, is emulsified with an emulsifier comprising an amine-containing polymer, as disclosed herein. In these and other various embodiments, the concentration of the emulsifier polymer may vary depending on, for example, the particular sizing composition employed, the particular pulp involved, the specific operating conditions, the contemplated end-use of the paper, and the like.

In at least some embodiments, concentrations of the amine-containing polymer range from 1 to 60 parts by weight polymer per 10 parts by weight sizing agent. In further embodiments, the concentrations range from 1 to 30 parts by weight polymer per 10 parts by weight sizing agent. In still further embodiments, the parts by weight of the polymer per 10 parts by weight sizing agent include the ranges 1 to 5, at least about 10, and 10 to 30. In various exemplary embodiments, the emulsion is ASA as the sizing agent emulsified with a DAA-containing polymer as the emulsifying agent.

In at least some embodiments, the emulsified sizing agent comprises from 0.01-40 percent by weight sizing agent. In further embodiments, the sizing agent comprises 1-20 percent by weight of the emulsified sizing agent. In still further embodiments, the emulsified sizing agent comprises 8-12 weight percent sizing agent. In these and other various embodiments, the emulsified sizing agent can comprise 0.001-20 percent by weight emulsifying agent polymer; in some embodiments, 0.1-10 percent by weight emulsifying agent polymer; and, in some still further, 1-5 percent by weight emulsifying agent polymer. In these and other various embodiments, as an example, the sizing agent can be ASA and the emulsifying agent polymer can be a DAA and/or DAA/AcAm.

In these and other various embodiments, for example, the sizing agent is ASA, AKD or mixtures thereof and the emulsifier is a polymer comprising at least one primary and/or secondary amine containing monomer, for example DAA or a copolymer of DAA and at least 1% of AcAm, methacrylamide or a mixture thereof; a dimethylaminoethylmethacrylate—methyl chloride quaternary polymer; glyoxalated polyacrylamide; aqueous carbohydrate dispersion, for example starch; or mixtures thereof. In an exemplary embodiment, the sizing agent comprises ASA which is emulsified with DAA or a copolymer of DAA and AcAm.

In at least some embodiments, the sizing agent, for example ASA, is emulsified in an amount of the sizing agent enhancer, as disclosed herein, essentially or mixed with or combined with a further emulsifier. In an exemplary, ASA is emulsified with an amount of DAA or DAA/AcAm, which is used as an emulsifier for the sizing agent and as a sizing agent enhancer. In a further exemplary embodiment, the DAA or DAA/AcAm is combined with starch or cooked starch and used to emulsify the ASA sizing agent.

To obtain advantageous sizing, it is generally desirable to uniformly disperse the sizing agents throughout the fiber furnish/slurry in as small a particle size as possible, in certain embodiments smaller than 2 micron. This may be achieved, for example, by emulsifying the sizing compositions prior to addition to the stock. Desired results normally refer to the average particle size and particle size distribution. Mechanical means for emulsification, for example, can include high-speed agitators, mechanical homogenizers, or turbine pumps. The latter is frequently employed to prepare stabilized size emulsions. The equipment must be capable of preparing an emulsion particle size in the range generally between about 0.01 and about 10 microns.

In at least some embodiments, the emulsified sizing agent has an emulsion particle size ranging from about 0.01 to about 10 microns. In some embodiments, the particle size is between about 0.5 to 3 microns. The emulsion size here refers to the median diameter of a volume percent distribution obtained with a Malvern Mastersizer laser diffraction instrument, available from Malvern Instruments, Ltd., Malvern, U. K. The median is defined as the diameter where 50% of the particles are greater than this value, and 50% are less than the value. The size of the emulsion can be controlled by the amount of energy and stabilizer added. Normally, the emulsion would be prepared from a mixture of the size, the polymeric stabilizer, and enough water to achieve desired dilution. As noted in, for example, U.S. Pat. Nos. 4,657,946 and 7,455,751, the disclosures of which are herein incorporated by reference, a surfactant of the sorts identified therein can be added to enhance the emulsification.

In certain embodiments, the emulsified sizing agent may optionally be used in combination with one or more materials that are cationic in nature or capable of ionizing or dissociating in such a manner as to produce one or more cations or other positively charged moieties. Such cationic agents have been found useful as a means for aiding in the retention of sizing compositions in paper, and those of skill in the art commonly refer to these as retention agents, aids, packages, and the like. Particularly suitable cationic agents include, for example, cationic starch derivatives, including primary, secondary, tertiary, or quaternary amine starch derivatives and other nitrogen substituted starch derivatives. Such derivatives may be prepared from all types of starches including corn, tapioca, potato, waxy maize, wheat, and rice. The cationic agents may be added to the stock, i.e., the pulp slurry, either prior to, along with, or after the addition of the emulsion. To achieve maximum distribution, it may be preferable to add the cationic agent subsequent to or in combination with the emulsion. The addition to the stock of the emulsion and/or cationic agent may take place at any point in the papermaking process prior to the ultimate conversion of the wet pulp into a dry web or sheet. Thus, for example, the present sizing compositions may be added . . . .

Further methods of preparation and application of and components and component concentrations for an emulsified sizing agent, of the present invention also can include one or more of those disclosed, described and claimed in U.S. Pat. Nos. 8,852,400, 8,709,207, and 8,840,759 and U.S. Publication Nos. 20150020988 and 20140336314. Emulsified sizing agents, as used herein, can also be referred to in such references as "sizing emulsions", "sizing mixtures", or "emulsified product". The disclosure of each of these references is herein incorporated by reference in their entireties.

Sizing Agent Enhancer

The sizing agent enhancer, also referred to as "sizing enhancer" comprises a polymer comprising at least one primary and/or secondary amine containing monomer (amine-containing polymers). In some embodiments, the polymer is a copolymer of diallylamine and acrylamide ("DAA/AcAm"). Further examples of a sizing agent enhancer include, but are not limited to, a copolymer of diallylamine and at least 1% of AcAm, methacrylamide or a mixture thereof; a dimethylaminoethylmethacrylate—methyl chloride quaternary polymer; glyoxalated polyacrylamide; aqueous carbohydrate dispersion; and mixtures thereof. In some embodiments, the sizing agent enhancer of the present invention can be one or more of the emulsifiers disclosed, described and claimed in U.S. Pat. Nos. 8,852,400, 8,709,207, and 8,840,759 and U.S. Publication Nos. 20150020988 and 20140336314. The disclosure of each of these references is herein incorporated by reference in their entireties.

In these and other various embodiments, the mole percentage of DAA in the polymer of the sizing agent enhancer can be within a range of 1 to 99 percent. In some embodiments, the polymer, for example a DAA/AcAm copolymer, can be primarily made up of DAA (more DAA monomer units than AcAm monomer units). In further embodiments, the mole percentage of DAA in the amine-containing polymer can be 1 to 60, and further 10 to 60, and still further 10 to 40. In various exemplary embodiments, the emulsifying agent is essentially DAA, DAA/AcAm or mixtures thereof.

Generally, the sizing enhancer polymers used in this disclosure may take the form of water-in-oil emulsions, dry powders, dispersions, or aqueous solutions. In certain embodiments, the sizing enhancer polymers may be prepared via free radical polymerization techniques in water using free radical initiation.

Other Additions/Additives

In certain embodiments, the emulsified sizing agent and the sizing agent enhancer of this disclosure may optionally be used in combination with one or more materials that are cationic in nature or capable of ionizing or dissociating in such a manner as to produce one or more cations or other positively charged moieties. Such cationic agents have been found useful as a means for aiding in the retention of sizing compositions in paper, and those of skill in the art commonly refer to these as retention agents, aids, packages, and the like. Among the materials that may be employed as cationic agents in the sizing process are, for example, alum, aluminum chloride, polyaluminum chloride, long chain fatty amines, sodium aluminate, substituted polyacrylamide, chromic sulfate, cationic thermosetting resins, and polyamide polymers. Examples of suitable cationic agents include cationic starch derivatives, including primary, secondary, tertiary, or quaternary amine starch derivatives and other cationic nitrogen substituted starch derivatives. Such derivatives may be prepared from all types of starches including corn, tapioca, potato, waxy maize, wheat, and rice. Moreover, they may be in their original granule form or they may be converted to pre-gelatinized, cold water soluble products and/or employed in liquid form.

In some embodiments, various further chemical additives can be added to the stock or fiber furnish at the Wet-end of the of the papermaking process. Examples include: acids and bases to control pH; sizing agents, including rosin, waxes, ASA and AKD for example, for water repellency or controlled rate of water absorption; dry strength additives; starch and various polymers used to improve strength and stiffness of paper; wet strength additives, for example polymers that crosslink to fiber surfaces, which can be used for paper grades such as toweling; fillers, for example clay, talc, $TiO_2$ (titanium dioxide), for improving optical and surface properties for printing grade papers; retention aids, for example polymers that improve retention of fiber fines and fillers; defoamers for improving water drainage and sheet formation; and slimicides for controlling slime growth and other microorganisms in paper machine whitewater. Further types of pigments and fillers may be added to paper that is to be treated, examples of which including calcium carbonate, calcium sulfate, and diatomaceous earths. Dyes can also be added to control sheet color.

Dosing Application

The combination of the emulsified sizing agent and the sizing agent enhancer can be injected or dosed in to the fiber furnish or stock flow via conventional methods of adding chemical additives in a papermaking process. The amounts and ratios of the emulsified sizing agent and sizing agent enhancer that can be dosed into the papermaking process may vary depending on, for example, the particular sizing composition employed, the particular pulp involved, the specific operating conditions, the contemplated end-use of the paper, and the like.

In various exemplary embodiments, the emulsified sizing agent is employed at a dose of from 0.05 to 20 pounds of the emulsified sizing agent per ton dry fiber (lb./ton) (weight of dry fiber herein on an as received basis) (measurement may also be of paper produced at the reel which contains 0-13% moisture). In further embodiments, the emulsified sizing agent is employed at a dose of from 0.5 to 10 pounds of the emulsified sizing agent per ton dry fiber, and, in some embodiments, at a dose of 1.5 to 20 pounds per ton dry fiber. In still further embodiments, the emulsified sizing agent is employed at a dose of from 3.0 to 7.0 pounds of the emulsified sizing agent per ton dry fiber.

In various exemplary embodiments, the sizing agent enhancer is employed at a dose of from 0.5 to 35 pounds of the sizing agent enhancer per ton dry fiber (lb./ton). In further embodiments, the sizing agent enhancer is employed at a dose of from 0.5 to 20 pounds of the sizing agent enhancer per ton dry fiber (lb./ton). In still further embodiments, the sizing agent enhancer is employed at a dose of from 2.0 to 12.5 pounds of the sizing agent enhancer per ton dry fiber (lb./ton).

In at least one embodiment, the emulsified sizing agent comprises ASA emulsified in essentially DAA and/or DAA/AcAm and is employed at a dose of from 0.05 to 20 pounds of the emulsified sizing agent per ton dry fiber (lb./ton) and the sizing agent enhancer comprises DAA/AcAm and is employed at a dose of from 0.5 to 35 pounds of the sizing agent enhancer per ton dry fiber (lb./ton).

In further embodiments, the emulsified sizing agent comprises ASA emulsified in essentially DAA and/or DAA/AcAm and is employed at a dose of from 0.05 to 10 pounds of the emulsified sizing agent per ton dry fiber (lb./ton) and the sizing agent enhancer comprises DAA/AcAm and is employed at a dose of from 0.5 to 20 pounds of the sizing agent enhancer per ton dry fiber (lb./ton).

In further embodiments, the emulsified sizing agent comprises ASA emulsified in essentially DAA and/or DAA/AcAm and is employed at a dose of from 3.0 to 7 pounds of the emulsified sizing agent per ton dry fiber (lb./ton) and the sizing agent enhancer comprises DAA/AcAm and is employed at a dose of from 2.0 to 12.5 pounds of the sizing agent enhancer per ton dry fiber (lb./ton).

In at least some embodiments, there is disclosed herein a method of sizing paper produced by a papermaking process. The method comprises; adding a sizing enhancer to a fiber furnish of a papermaking process; and adding an emulsified sizing agent to the fiber furnish. The sizing enhancer comprises a copolymer having a mole percent of diallylamine ranging from about 1 to about 60 percent and the emulsified sizing agent comprises 0.01-40 wt % sizing agent and 0.001-20 wt % emulsifier polymer. The sizing agent is selected from the group consisting of an alkyl ketene dimer, an alkenyl succinic anhydride or mixtures thereof emulsified with the emulsifier polymer comprises at least one primary or secondary amine containing monomer. The sizing enhancer is added separately or contemporaneously with the emulsified sizing agent. In at least some embodiments, the sizing enhancer comprises a copolymer of diallylamine and acrylamide. In these and other various embodiments, the emulsifier polymer can comprise diallylamine monomers, and in some embodiments, the emulsifier polymer comprises essentially diallylamine monomers or comprises a copolymer of diallylamine and acrylamide. In at least one embodiment, the emulsifier polymer is combined with starch.

In at least some embodiments, there is disclosed herein a method of sizing paper produced by a papermaking process. The method comprises adding an emulsified sizing agent to the fiber furnish of the papermaking process. The emulsified sizing agent comprises 0.01-40 wt % sizing agent and 0.001-20 wt % emulsifier polymer. The sizing agent is selected from the group consisting of an alkyl ketene dimer, an alkenyl succinic anhydride or mixtures thereof and the emulsifier polymer comprises diallylamine monomers. In at least some embodiments, the emulsifier polymer comprises essentially diallylamine monomers or comprises a copolymer of diallylamine and acrylamide. In at least one embodiment, the emulsifier polymer is combined with starch.

In at least one embodiment, the present invention includes a commercial package containing amounts of the emulsified sizing agents and/or sizing enhancers disclosed herein with printed materials. In at least some embodiments, the printed material indicates information regarding the contained emulsified sizing agent and/or sizing enhancer. In some embodiments, the printed material indicates preparation and/or use instructions for the emulsified sizing agent and/or sizing enhancer.

In certain embodiments, the emulsified sizing agent is added to the papermaking process at a point selected from the group consisting of: in the fiber furnish, thick or thin stock, prior to a headbox; in thin-stock furnish prior to a headbox; in thin-stock furnish prior to screening; in thin-stock furnish after the fan pump and prior to screening; in thin-stock furnish after screening and at or prior to the headbox; and any combination thereof.

In certain embodiments, the sizing agent enhancer is added to the papermaking process, in combination with the addition of the emulsified sizing agent above, at a point selected from the group consisting of: in thick-stock furnish;

in thin-stock furnish; in thick-stock furnish after the MC; in thin-stock furnish at or prior to the headbox; in thin-stock furnish prior to screening; in thin-stock furnish prior to the fan pump; in thin-stock furnish after the fan pump and prior to screening; in thin-stock furnish after screening and at or prior to the headbox; between screening and the headbox; and any combination thereof.

In certain embodiments, the sizing agent enhancer and the emulsified sizing agent, respectively, are added to the papermaking process in an order selected from the group consisting of: the sizing agent enhancer and then the emulsified sizing agent; after screening, the sizing agent enhancer and the emulsified sizing agent; after screening, the sizing agent enhancer and the emulsified sizing agent; the sizing agent enhancer contemporaneously with the emulsified sizing agent; and any combination thereof.

In certain embodiments, a mixing chamber is used to introduce the emulsified sizing agent and the sizing agent enhancer into the papermaking process. Examples of such mixing chambers are disclosed in U.S. Pat. Nos. 7,550,060; 7,785,442; 7,938,934; and 7,981,251, the disclosures of each of which are herein incorporated by reference (e.g., PARETO Mixing Technology, available from Nalco Company, 1601 West Diehl Road, Naperville, Ill. 60563), and the Ultra Turax, model no. UTI-25 (available from IKA® Works, Inc., Wilmington, N.C.). It is envisioned that any suitable reactor or mixing device/chamber may be utilized in the methods disclosed herein to introduce the oil-in-water emulsion.

The combination of an emulsified sizing agent and a sizing agent enhancer, as disclosed herein, are useful for the sizing of paper prepared from all types of both cellulosic and combinations of cellulosic with non-cellulosic fibers. Example cellulosic fibers that may be used include, for example, Representative furnishes include, for example, virgin pulp, recycled pulp, kraft pulp (bleached and unbleached), sulfite pulp, mechanical pulp, polymeric plastic fibers, the like, any combination of the foregoing pulps, sulfate (a.k.a. Kraft), sulfite, soda, neutral sulfite semi-chemical ("NSSC"), thermomechanical ("TMP"), chemi-thermomechanical ("CTMP"), groundwood ("GWD"), and any combination of these fibers. Any of the foregoing cellulosic fibers may be bleached or unbleached and include pre- and/or post-consumer recycled paper. These designations refer to wood pulp fibers that have been prepared by any of a variety of processes that are typically used in the pulp and paper industry. In addition, synthetic fibers of the viscose rayon or regenerated cellulose type may be used.

It is believed that there are at least particular advantages to the use of the combinations of emulsified sizing agents and sizing agent enhancers disclosed herein as opposed to conventional sizing agents. Such advantages include, but are not limited to, high increase in size efficiency; additional strengthening; improved dewatering; in some cases, steam reduction; minimizes ASA hydrolysis; lower costs; and improves machine runnability.

In various other embodiments disclosed herein, solutions of the emulsified sizing agents, as disclosed herein, alone or in combination with the sizing agent enhancers, as disclosed herein, are applied to paper during a papermaking process at/via the size press of a papermaking machine. In at least some embodiments, the solutions are applied via the roll applicator (flooded nip) or Nozzle applicator of a size press. It can be placed before the last dryer section. Such applications are at least particularly advantageous in that they improve the paper's water resistance, decrease its ability to fuzz, reduce abrasiveness, and improve its printing properties and surface bond strength. In at least some embodiments, the solutions can be added via a 'coater' to apply a coating of the solutions, which can be suspended in a binder, such as cooked starch and styrene-butadiene latex. These applications can be made alone or in combination with the internal sizing applications disclosed herein.

The patents or publications referenced in this disclosure are herein incorporated by reference in their entireties for all purposes including describing and disclosing the chemicals, materials, instruments, statistical analyses, and methodologies which are reported in the patents and publications which might be used in connection with the invention or which may expand the understanding and scope of the embodiments and claims of the presently disclosed invention. All references cited in this specification are to be taken as indicative of the level of skill in the art. Nothing herein is to be construed as an admission that the invention is not entitled to antedate such disclosure by virtue of prior invention.

EXAMPLES

The foregoing may be further understood by reference to the following examples, which are presented for purposes of illustration and are not intended to limit the scope of the invention. In particular the examples demonstrate representative examples of principles innate to the invention and these principles are not strictly limited to the specific condition recited in these examples. As a result it should be understood that the invention encompasses various changes and modifications to the examples described herein and such changes and modifications can be made without departing from the spirit and scope of the invention and without diminishing its intended advantages. It is therefore intended that such changes and modifications be covered by the appended claims.

Figure 2:
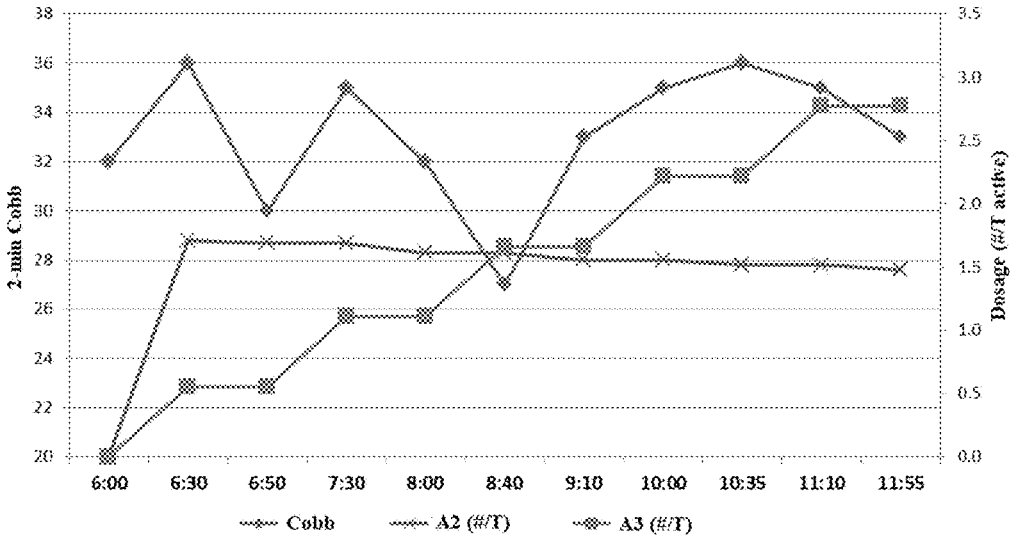
FIG. 2 is a graph showing results of a Cobb test.

Various studies were conducted to show effects of using a sizing agent enhancer with an emulsified sizing agent. In FIG. 2, there is shown the results of a 2 minute Cobb test using samples of an emulsified sizing agent, which comprised ASA emulsified with DAA/AcAm (Samples A2) and samples of a sizing agent enhancer, which comprise a diallylamine/acrylamide copolymer (Samples A3). The Cobb value is labeled "Cobb".

The test method used is titled Water Absorption Test (Tappi method T-441 om-09). The Cobb value indicates the mass of water absorbed in time for a square meter of paper. The efficiency of a sizing agent can be shown in a Cobb test. Sizing improvement is shown as a decrease in Cobb number.

In the test, the active dosage of the emulsifier in Samples A2 was held substantially steady (ASA is emulsified with DAA at a ratio of 0.6:1.0). The dosage of the sizing agent enhancer (Sample A3) was steadily increased. The right vertical of the graph indicates the dosage for samples A2 and A3 (lbs./T active). The bottom of the graph indicates lbs./T.

The graph of FIG. 2 illustrates trial data, wherein parameters for samples, as noted in the graph, were adjusted to optimize sizing performance as measured by Cobb. The time indicated on the x-axis shows time at which each set of data was taken and chemical dosages were changed. The data shown illustrates the times at which a paper/board sample was removed and tested. Each time stamp is a different set of data (different Cobb test).

As can be seen, the efficiency of the emulsified sizing agent increases (as the Cobb number drops) as the dosage of the sizing agent enhancer increases. The graph of FIG. 2 shows an optimal concentration of DAA/AcAm that gives good sizing performance. As the dosage of the sizing enhancer, DAA/AcAm in this case (Samples A3), is increased past an optimal point, the Cobb values begin to increase as sizing efficiency decreases.

Figure 3:
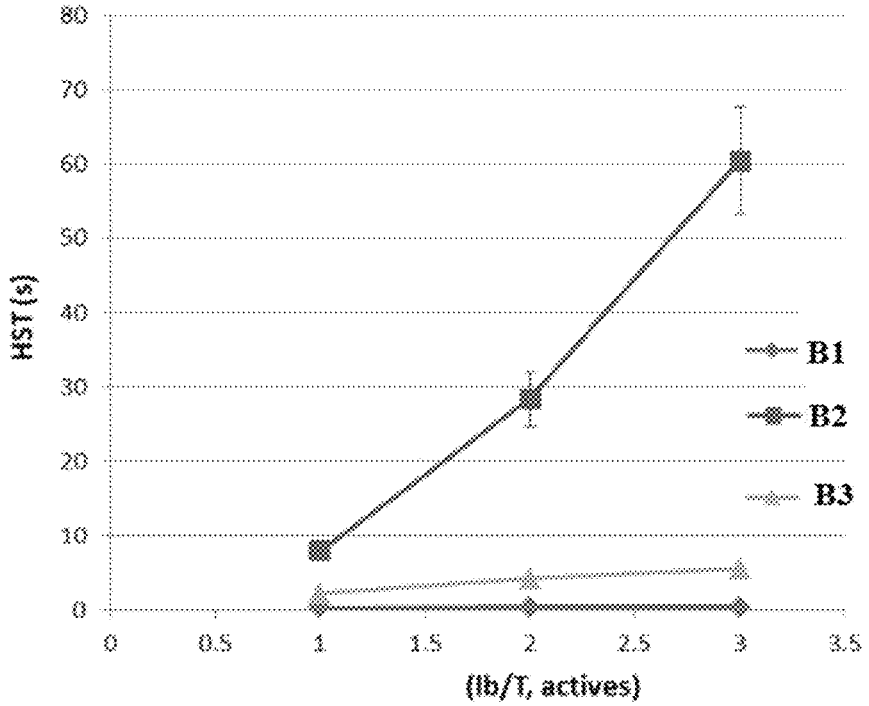
FIG. 3 is a graph showing a comparison of samples in Hercules Sizing Testing.
Figure 4:
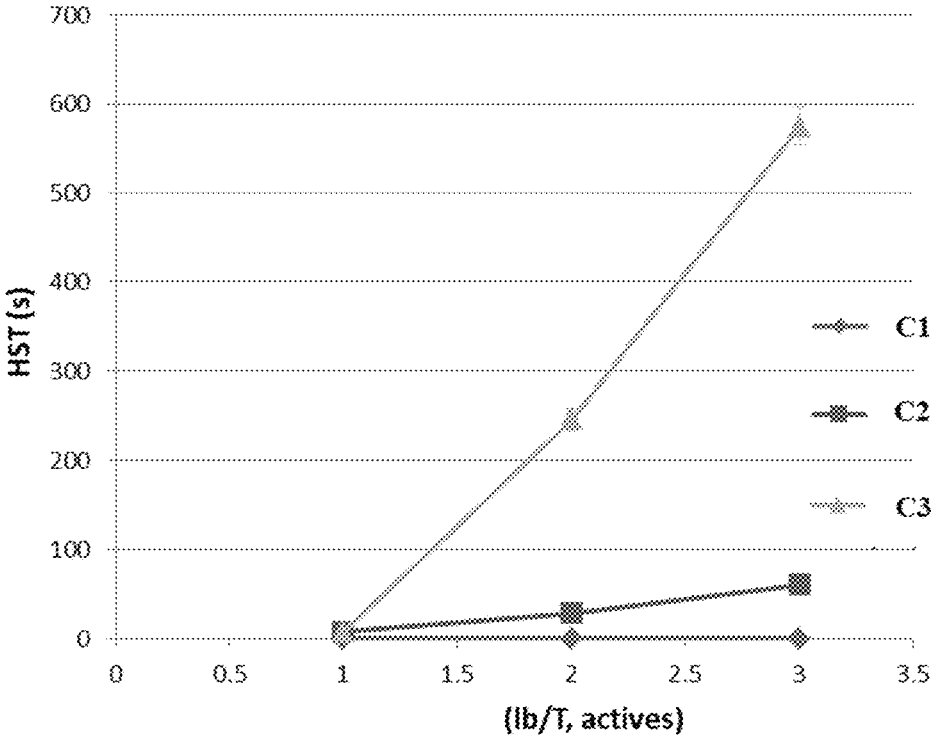
FIG. 4 is a graph showing a comparison of samples in Hercules Sizing Testing.
Figure 5:
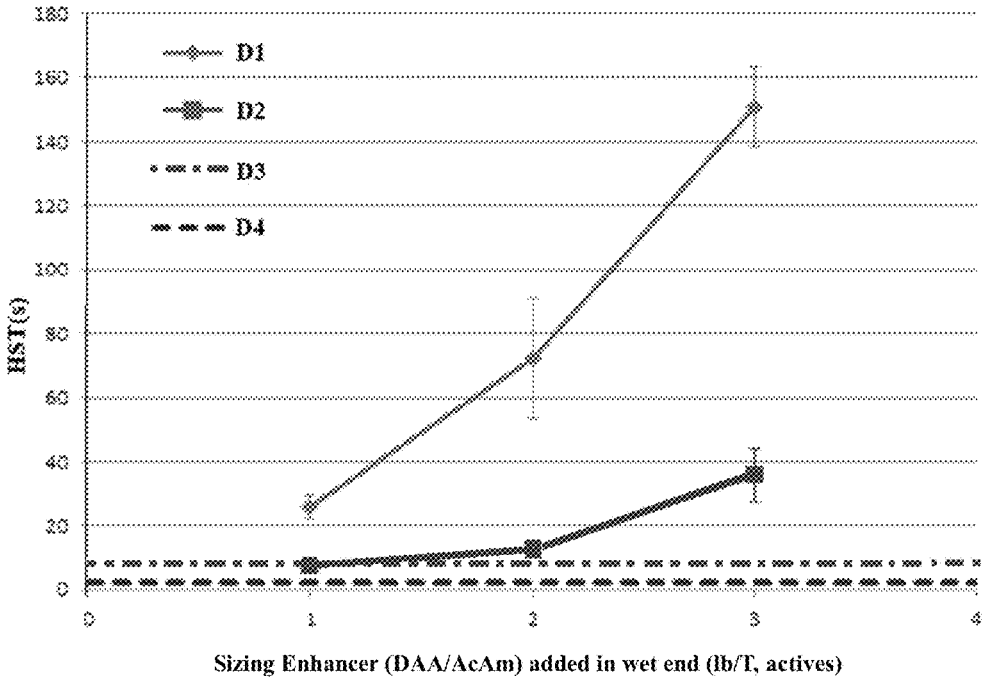
FIG. 5 is a graph showing a comparison of samples in Hercules Sizing Testing.

In FIGS. 3-5, there are shown further results of effects of using a sizing agent enhancer with an emulsified sizing agent. In each of the graphs of FIGS. 3-5, sizing performance was measured in Hercules Sizing Tests, which use a Hercules Sizing Tester ("HST"). Such tests and tester are well known to those skilled in the art. The HST is an instrument that measures the time it takes for an acid ink solution to penetrate through a paper/paperboard sample and reduce the reflectance of a light source to a predetermined value. The more liquid resistance the sample has the longer it will take for the acid ink solution to penetrate. Thus, sizing performance improves as the HST number increases. This is opposite of a Cobb measurement where sizing performance improves as the Cobb number decreases.

Referring to the graph shown in FIG. 3, there is shown results of three different sizing programs that were run and measured for sizing performance by HST. The y-axis is the HST value in seconds and x-axis indicates lb./T for the active sample compositions, in this case active amount of the sample compositions that was added based on amount of paper produced (pounds dosed per ton of paper produced).

In FIG. 3, Samples B1 represent a sizing agent enhancer, as disclosed herein, alone comprising DAA/AcAm and represent dosing DAA/AcAm by itself as a wet-end additive without any emulsified sizing agent or sizing agent, such as ASA. As can be seen in the graph, the results for Samples B1 show that the HST value does not improve for the sizing enhancer alone with an increase in DAA/AcAm (x-axis).

Samples B3 represent an emulsified sizing agent comprising ASA emulsified with an emulsifier, which is commercially sold under the name Nalsize® 7541 and is available from Nalco Company, 1601 West Diehl Road, Naperville, Ill. 60563. As can be seen in FIG. 3, the amount of emulsifier used to emulsify ASA was increased so that the amount of the emulsifier being added to the sheet increased from 1 lb./T to 3 lb./T active composition, but the dose of ASA remained the same, 1 lb./T, thereby increasing the emulsifier to sizing agent ratio.

Samples B2 are the same as Samples B3, except that DAA/AcAm is used as an emulsifier, as disclosed herein, in place of Nalsize® 7541. Similarly, the sizing agent, ASA, of Samples B2 was emulsified prior to being dosed to the sheet with the emulsifier (DAA/AcAm). The amount of emulsifier used to emulsify the ASA also was increased so that the amount of the emulsifier being added to the sheet increased from 1 lb./T to 3 lb./T active polymer, but the dose of ASA remained the same, 1 lb./T, thereby increasing the emulsifier to sizing agent ratio.

As for Samples B3, which represent 1 lb./T of ASA sizing agent and an increasing amount of emulsifier (Nalsize® 7541), the results show that sizing performance improves slightly as the amount of emulsifier added to the sheet increases. However, as for Samples B2, which represent 1 lb./T of ASA sizing agent and an increasing amount of emulsifier (DAA/AcAm), as disclosed herein, the results show that, although the amount of ASA size is constant, adding more DAA/AcAm, as disclosed herein, significantly improves sizing.

Samples B1 show that just the presence of increased amounts of enhancer, in this case DAA/AcAm, does not significantly improve sizing. However, Samples B2 show that the increased amounts of sizing enhancer (DAA/AcAm), as disclosed herein, in the presence of the emulsified ASA sizing agent dramatically improves the sizing efficiency of a fixed amount of ASA size. This was an unexpected result based on the trend observed when viewing the results for Samples B1. As illustrated by the graph of FIG. 3, DAA/AcAm used as an emulsifier, as disclosed herein, has a significant performance advantage compared to the commercially available emulsifier of Samples B3.

Regarding the testing and graph of FIG. 3, it is important to mention that Sample B1 was tested using 1% HST acid ink while Samples B2 and B3 were tested using 20% acid ink. The increase in acid ink concentration is due to the high sizing performance offered by these methods and also indicates that when dosing DAA/AcAm by itself with no sizing agent very little sizing performance is gained compared to the other methods. Samples C1, C2, and C3, respectively, Referring to the graph shown in FIG. 4, testing similar to the testing of FIG. 3 was conducted on Samples C1, C2 and C3. Samples C1 and C2 are the same as Samples B1 and B2, respectively. It is important to note the change in scale of the y-axis in the graph of FIG. 4 compared to that of the graph in FIG. 3, which explains the difference in separation. Samples C2 and C3 were tested using 20% acid ink.

Samples C3 are emulsified sizing agent comprising ASA emulsified with DAA/AcAm. In contrast to Sample B3, the emulsification ratio of emulsifier to sizing agent of was fixed in this case and not changed. Instead, the amount of ASA added to the sheet was increased. As such, even though the amount of DAA/AcAm being added was increasing, there was also more sizing agent (ASA) present in the sheet.

As shown for Samples C3, the presence of the additional sizing agent (ASA) significantly improves sizing performance in the presence of DAA/AcAm compared to Samples C2, where the amount of sizing agent (ASA) was fixed at 1 lb./T. As shown, when DAA/AcAm is used as an emulsifier, the sizing response correlates to the amount of sizing agent being used. The test also demonstrates that it is possible to in effect "tune" the sizing performance by adjusting the emulsification ratio and/or the amount of sizing agent being added to the papermaking process.

Referring to the graph shown in FIG. 5, testing was conducted to show the effect of adding a sizing agent enhancer in a wet-end of a papermaking process. Samples D1 are an emulsified sizing agent comprising ASA emulsified with DAA/AcAm at a 1:1 ratio, as disclosed herein. Samples D2 are an emulsified sizing agent comprising ASA emulsified with NALSIZE® 7541 at a 1:1 ratio. Samples D3 and D4 represent the reference sizing performance of 1 lb./T ASA at the fixed emulsification ratio using DAA/AcAm and NALSIZE® 7541, respectively, as emulsifiers. The line of D3 represents 1 lb./T ASA and 1 lb./T of DAA/AcAm and the line of D4 represents 1 lb./T ASA and 1 lb./T of Nalsize 7541.

For the testing, DAA/AcAm was used as the sizing agent enhancer. For Samples D1 and D2, the emulsified sizing agent and the sizing enhancer were added consecutively, with the sizing enhancer, DAA/AcAm, being dosed first followed by the emulsified sizing agent. For Samples D1 and D2, 1, 2, and 3 lb./T of DAA/AcAm was added. As such, Samples D1 had a total of 2, 3, and 4 lb./T DAA/AcAm and Samples D2 had a total of 1, 2 and 3 lb./T DAA/AcAm and 1 lb./T Nalsize 7541.

As seen in the graph, the presence of the sizing agent enhancer, in this case DAA/AcAm, improves the sizing performance of the emulsified sizing agent in both Samples D1 and D2. The effect was significantly more pronounced for Samples D1, wherein the ASA was initially emulsified with DAA/AcAm.

As illustrated, the presence of a sizing agent enhancer, such as DAA/AcAm, used in the Wet-end of a papermaking process can improve or enhance sizing efficiency. It is shown that this effect is increased significantly wherein the emulsifier and the enhancer are the same, for example, both the emulsifier and the enhancer are DAA/AcAm.

While this invention may be embodied in many different forms, there are shown in the drawings and described in detail herein specific embodiments of the invention. The present disclosure is an exemplification of the background and principles of the invention and is not intended to limit the invention to the particular embodiments illustrated. All patents, patent applications, scientific papers, and any other referenced materials mentioned anywhere herein are incorporated by reference in their entirety for all purposes, including in providing materials, formulations, formulation methods and methods for making, performing and using as they relate to the methods and compositions of the present invention. Furthermore, the invention encompasses any possible combination of some or all of the various embodiments described herein and incorporated herein.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

References to "embodiment(s)", "disclosure", "present disclosure", "embodiment(s) of the disclosure", "disclosed embodiment(s)", and the like contained herein refer to the specification (text, including the claims, and figures) of this patent application that are not admitted prior art.

All ranges and parameters disclosed herein are understood to encompass any and all subranges subsumed therein, and every number between the endpoints. For example, a stated range of "1 to 10" should be considered to include any and all subranges between (and inclusive of) the minimum value of 1 and the maximum value of 10; that is, all subranges beginning with a minimum value of 1 or more, (e.g. 1 to 6.1), and ending with a maximum value of 10 or less, (e.g. 2.3 to 9.4, 3 to 8, 4 to 7), and finally to each number 1, 2, 3, 4, 5, 6, 7, 8, 9, and 10 contained within the range.

Various embodiments of the present invention have been described. Nevertheless, it will be understood that various modifications may be made without departing from the spirit and scope of the invention. Those skilled in the art may recognize other equivalents to the specific embodiment described herein which equivalents are intended to be encompassed by the claims attached hereto. For purposes of interpreting the claims for the present invention, it is expressly intended that the provisions of Section 112, sixth paragraph of 35 U.S.C. are not to be invoked unless the specific terms "means for" or "step for" are recited in a claim.

The invention claimed is:

1. A method of sizing paper produced by a papermaking process, the method comprising:

adding a sizing enhancer to a fiber furnish of a papermaking process at or before a headbox of the papermaking process, the sizing enhancer comprising a polymer comprising at least one primary or secondary amine containing monomer, wherein the sizing enhancer is not emulsified with a sizing agent;

adding an emulsified sizing agent to the fiber furnish, wherein the emulsified sizing agent comprises a sizing agent selected from the group consisting of an alkyl ketene dimer, an alkenyl succinic anhydride or mixtures thereof emulsified with an emulsifier polymer comprising at least one primary or secondary amine containing monomer, and the emulsified sizing agent being added at or before the headbox and:

after the sizing enhancer, wherein the emulsified sizing agent is added before or after screening in the papermaking process;

before the sizing enhancer, wherein the emulsified sizing agent is added before or after screening and the sizing agent is added after screening; or contemporaneously with the sizing enhancer, wherein both the sizing enhancer and the emulsified sizing agent are added after screening; and making a paper product out of the fiber furnish according to a papermaking process.

2. The method of claim 1, the polymer of the sizing enhancer being a copolymer of diallylamine and acrylamide.

3. The method of claim 2, wherein the emulsified sizing agent is added to a thin-stock furnish flow.

4. The method of claim 3, wherein the sizing enhancer is added to the thin-stock furnish before screening in the papermaking process.

5. The method of claim 3, wherein the sizing enhancer is added after screening in the papermaking process.

6. The method of claim 2, wherein the emulsified sizing agent and the sizing enhancer are added contemporaneously or in immediate succession to the thin-stock furnish flow after screening in the papermaking process.

7. The method of claim 2, the emulsified sizing agent comprising an oil-in-water emulsion, the oil-in-water emulsion comprising: an alkenyl succinic anhydride emulsified with the emulsifier polymer comprising from 1 to 60 mol % of at least one amine-containing vinyl- or allyl-monomer, and the remainder of the emulsifier polymer comprising a nonionic monomer selected from the group consisting of: acrylamide, methacrylamide, N,N-dimethylacrylamide, N,N-diethylacrylamide, N-isopropylacrylamide, N-vinylformamide, N-vinylmethylacetamide, N-vinyl pyrrolidone, hydroxyethyl methacrylate, hydroxyethyl acrylate, hydroxypropyl acrylate, hydroxypropyl methacrylate, N-t-butylacrylamide, N-methylolacrylamide, vinyl acetate, vinyl alcohol, and combinations thereof, wherein the emulsified sizing agent has an emulsion particle size ranging from about 0.01 to about 10 microns.

8. The method of claim 1, the polymer of the sizing enhancer comprising: a copolymer of diallylamine and at least 1% of AcAm, methacrylamide or a mixture thereof; a dimethylaminoethylmethacrylate—methyl chloride quaternary polymer; glyoxalated polyacrylamide; an aqueous carbohydrate dispersion; or mixtures thereof.

9. The method of claim 8, wherein the emulsified sizing agent comprises 8-12 weight percent of the sizing agent and 1-5 weight percent of the emulsifier polymer.

10. The method of claim 8, wherein the adding of the emulsified sizing agent is performed at a dosage rate of 0.5 lbs. to 20 lbs. of the emulsified sizing agent per ton of dry fiber.

11. The method of claim 8, wherein the emulsifier polymer of the emulsified sizing agent has a mole percent of diallylamine ranging from about 10 to about 40 percent.

12. The method of claim 8, wherein the emulsified sizing agent comprises from 0.01 weight percent to 40 weight percent alkenyl succinic anhydride and from 0.001 weight percent to 20 weight percent emulsifier polymer.

13. The method of claim 8, wherein the adding of the sizing enhancer is performed at a dosage rate of 0.5 lbs. to 35 lbs. of the sizing enhancer per ton of dry fiber.

14. The method of claim 8, wherein the adding of the sizing enhancer is performed at a dosage rate of 2.0 lbs. to 12.5 lbs. of the sizing enhancer per ton of dry fiber.

15. A method of sizing paper during the papermaking process, the method comprising: adding an oil-in-water emulsion to the papermaking process in an amount sufficient to size the paper; wherein the oil-in-water emulsion comprises alkenyl succinic anhydride emulsified with a copolymer consisting of diallylamine and at least one of acrylamide; and adding after screening and at or before a headbox in the papermaking process a sizing enhancer to the papermaking process in an amount sufficient to enhance the oil-in-water emulsion in the size of the paper, wherein the sizing enhancer comprising at least one primary or secondary amine containing monomer, and the sizing enhancer is not emulsified with a sizing agent.

16. The method of claim 15, wherein the sizing enhancer comprises a copolymer of diallylamine and acrylamide.

17. The method of claim 16, wherein the adding of the emulsified sizing agent is performed at a dosage rate of 0.5 lbs. to 20 lbs. of the emulsified sizing agent per ton of dry fiber and the adding of the sizing enhancer is performed at a dosage rate of 0.5 lbs. to 35 lbs. of the sizing enhancer per ton of dry fiber.

18. The method of claim 16, wherein the adding of the emulsified sizing agent is performed at a dosage rate of 0.5 lbs. to 10 lbs. of the emulsified sizing agent per ton of dry fiber and the adding of the sizing enhancer is performed at a dosage rate of 2.0 lbs. to 12.5 lbs. of the sizing enhancer per ton of dry fiber.

* * * * *